United States Patent [19]

Stunkel

[11] 4,085,659

[45] Apr. 25, 1978

[54] CONTROL DEVICE FOR POWER TOOLS

[76] Inventor: Barry A. Stunkel, 1170 West Fork, Lake Forest, Ill. 60045

[21] Appl. No.: 691,005

[22] Filed: May 28, 1976

[51] Int. Cl.[2] ..... F15B 15/22

[52] U.S. Cl. ..... 92/8; 92/13.8; 92/63; 92/130 C

[58] Field of Search ..... 92/11, 12, 85 B, 85 A, 92/85 R, 63, 10, 8, 130 C, 13.8; 91/170

[56] References Cited

U.S. PATENT DOCUMENTS

| | | | |
|---|---|---|---|
| 538,840 | 5/1895 | Morgan, Sr. | 92/85 B |
| 823,480 | 6/1906 | McLeod | 92/85 B |
| 1,785,759 | 12/1930 | Baumgartner | 92/12 |
| 2,408,338 | 9/1946 | Parsons | 92/85 A |
| 3,094,902 | 6/1963 | Riopelle | 92/12 |
| 3,431,985 | 3/1969 | Bowen | 92/85 B |
| 3,698,826 | 10/1972 | Henderson | 92/11 |

*Primary Examiner*—Paul E. Maslousky

[57] ABSTRACT

A powered tool control device having a pair of coaxial pistons, with the first piston effective to move the second piston after completing a predetermined amount of pretravel initiated by a prescribed operational condition of the powered tool and with resulting movement of the second piston controlled by fluid directional regulators responsive to different operational conditions of the powered tool.

2 Claims, 1 Drawing Figure

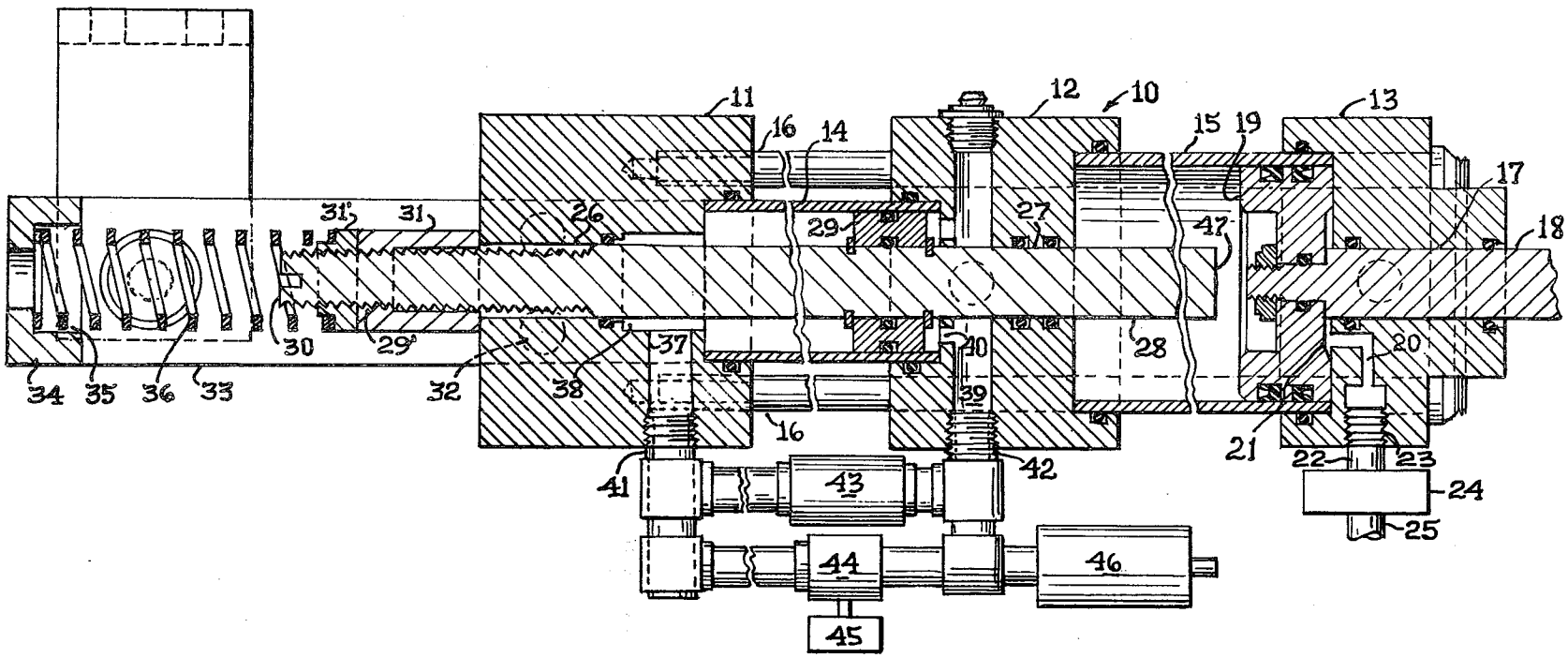
10
11
12
13
14
15
16
17
18
19
20
21
22
23
24
25
26
27
28
29
29'
30
31
31'
32
33
34
35
36
37
38
39
40
41
42
43
44
45
46
47

CONTROL DEVICE FOR POWER TOOLS

SUMMARY OF THE INVENTION

The operational control device of this invention employs tandem coaxially arranged pistons, one of which is pneumatically movable, while the other is hydraulically movable, with the latter including control valves for determining its speed of movement by regulating the transfer of hydraulic fluid within the piston. Hydraulic control valves are responsive to energization of a solenoid that constitutes part of the electrical circuitry of the associated power tool.

As an example of one of the objects of this invention, consider its associated with an operating bending machine wherein it is advantageous to permit the ram to move initially at an unrestricted speed toward the workpiece under the influence of pneumatic pressure, and thereafter to be restricted or restrained so as to move at a decreased prescribed speed by hydraulic transfer means during the bending operation of the ram.

The control device also provides a means for adjusting the spacing between the coaxial pistons to regulate the degree of pretravel the pneumatically actuated piston has during its unrestrained initial movement before contact and coaxially moving the hydraulically controlled piston.

GENERAL DESCRIPTION

The invention will be best understood by reference to the accompanying drawing which illustrates the preferred mode by which the objects of the invention are achieved and in which the single FIGURE is a side elevational detailed sectional view of the control device.

The control device 10, as illustrated in the drawing consists of heads 11, 12 and 13, with the head 11 connected to the head 12 by a cylinder tube 14, while the head 12 is connected to the head 13 by a cylinder tube 15. These components are fastened together by suitable tie rods 16, as shown.

Through a center bore 17 formed in the head 13 slidably projects a piston rod 18. At its inner end the piston rod 18 carries the piston 19, which is adapted to move within the cylinder tube 15.

Formed in the head 13 is an inlet port 20 which has communication with an air chamber 21 formed in one face of the piston 19. The inlet port 20 has open communication with a threaded nipple of an air inlet tube 22 threadably projected into a receiving aperture 23 formed in the head 13. The air inlet tube 22 is connected to a suitable air valve 24, which in turn has an air supply 25, as shown.

Adapted to be projected through center bores 26 and 27 formed in the heads 11 and 12, respectively, is an elongated piston rod 28. This piston rod 28 carries a piston 29 adapted to be movable within the cylinder tube 14. One of the extreme ends of the piston rod 28 is adapted to be disposed within the cylinder tube 15 and in the path of movement of one end of the piston rod 18, as shown. The opposite end of the piston rod 28 is adapted to be threaded as a 29' and projects outwardly through the head 11. This exposed end 30 of the piston rod 28 is adapted to hve threaded thereon and adjusting nut 31 as well as a spring retainer 31'. Fastened by suitable screws 32 to one side of the head 11, is a mounting plate 33 which provides an end cap 34 recessed to provide a spring seat 35. Adapted to extend between the spring retainer 31' and the cap 34 is a coil spring 36.

The head 11 is provided with an inlet passage 37 which has open communication with an annular chamber 38 adapted to surround the piston rod 28, with the chamber 38 having open communication with the interior of the cylinder tube 14 to one side of the piston 29. Formed in the head 12 is a like inlet passage 39 having open communication with inlet ports 40 that in turn have open communicaion with the interior of the cylinder tube 14 to the other side of the piston 29.

By suitable couplings 41 and 42, the inlet passages 37 and 39 are connected to a flow control valve 43 which is connected in parallel to a pilot valve 44. The pilot valve 44 in turn is connected to a control solenoid 45. It is desired that the moving force employed against the piston 29 constitute hydraulic fluid, and therefore there is a hydraulic fluid reservoir 46 in open communication with the couplings between the valves 43 and 44 and the respective inlet passages 37 and 39.

The operation of the device is such that when the control device 10 is connected to a powered tool which initially requires the controlled movement of the piston rod 18, the operation of the powered tool will effect the operation of the air valve 24, permitting pneumatic pressure to be introduced into the chamber 21 against the piston 19 so as to move the same through the cylinder tube 15. During the movement of the piston 19 and its associated piston rod 18, it will engage the free end 47 of the coaxially displaced piston rod 28, causing the same, together with its piston 29, to move in a like direction in the tube 14. However, the movement of the piston 29 is regulated by the transfer of hydraulic fluid from one side of the piston 29 to the other side thereof. This fluid movement occurs through the pilot valve 44, which is normally open and which permits rapid transfer of the fluid from the chamber 38 through the inlet passage 37, the valve 44, the inlet passage 39, and ports 40, to the other side of the piston 29. There is associated with the power tool an electric circuit control which will effect energization of the control solenoid 45, which will then close the pilot valve 44 and cause the transfer of the hydraulic fluid to take place through the control valve 43, which by its construction permits a restricted or restrained transfer flow of the fluid therethrough. This in turn then will regulate the speed of coaxial movement of the piston rods 18 and 28, as viewed in the drawing, from right to left. This movement is normally against the action of the coil spring 36, which, when the pneumatic pressure is relieved against the piston 19, will force the return of the piston rods 18 and 28 to the position shown.

It should be noted that, by the adjustment nut 31, the relative positions between the free end 47 of the piston rod 28 and the confronting end of the piston rod 18 may be varied so as to establish a pretravel of the piston rod 18 and its piston 19 through the cylinder tube 15 by pneumatic pressure before it contacts or engages the piston 28.

It should be noted that the exposed end of the piston rod 18 may be associated with a coil spring, such as that shown at 36, for effectively returning the piston rod 18 and its piston 19 to their initial position with respect to the cylinder tube 15, as shown in the drawing. However, it may be that the connection between the piston rod 18 and an associated movable part of the power tool will function in a like manner to return the piston rod and piston 19 to such position.

From the foregoing, it is apparent that the control device consists of a tandem arrangement of coaxial pistons, one of which is initially moved by pneumatic pressure controlled by an operational condition of the associated machine, and the other of which pistons is controlled by hydraulic pressure which, when desired, can be controlled so as to restrict the speed of transfer of the hydraulic pressure to either side of the piston 29, thus controlling the speed of coaxial movement of the piston rod 18.

While I have illustrated and described the preferred form of construction for carrying my invention into effect, this is capable of variation and modification without departing from the spirit of the invention. I therefore, do not wish to be limited to the precise details of construction set forth, but desire to avail myself of such variations and modifications as come within the scope of the appended claims.

Having thus described my invention, what I claim as new and desired to protect by Letters Patent is:

1. A movement control device for power tools comprising (a) a housing providing a pair of axially aligned independent cylinders, (b) a first piston in one cylinder and having an elongated piston rod extending from one side thereof and out of one end of said housing, (c) a second piston in the second cylinder mounted upon an elongated piston rod intermediate its ends, with said rod disposed in both cylinders and having one end extending out of the other end of said housing, (d) a source of driving medium having communication with said one cylinder for moving said first piston in the direction of said second piston and into contact therewith for correspondingly moving said second piston in one direction in said second cylinder, (e) resilient means exteriorly of said housing and connected to said one end of said second piston rod for moving the same in an opposite direction through said second cylinder, (f) a hydraulic system in connection with said second cylinder and having open communication to both sides of said second piston therein, (g) valve means in said hydraulic system restrictively regulating the flow of fluid from said second cylinder through said hydraulic system so as to regulate the speed of movement of said second piston in one direction by corresponding movement of said first piston through said first cylinder, and (h) an electrically controlled flow valve connected in parallel to said valve means in said hydraulic system and having an open and a closed position and adapted to permit, in its open position, free flow of hydraulic fluid therethrough in either direction by movement of said second piston as said said second piston is moved by said first piston and said resilient means, said resilient means comprising a coil spring engaging a spring retainer at one end of said second piston rod exteriorly of said housing so as to move the same in one direction through said second cylinder.

2. A movement control device for power tools as defined by claim 1 including adjusting means carried on said one end of said piston rod of said second piston exteriorly of said housing for axially adjusting said piston rod and said second piston within said second cylinder and relative to said first piston in said one cylinder.

* * * * *